United States Patent [19]

Boole

[11] Patent Number: 4,624,502

[45] Date of Patent: Nov. 25, 1986

[54] PORTABLE DRAWER ASSEMBLY

[76] Inventor: Leon J. Boole, P.O. Box 31, Newtonville, Mass. 02160

[21] Appl. No.: 673,669

[22] Filed: Nov. 21, 1984

[51] Int. Cl.[4] ..... A47C 7/62

[52] U.S. Cl. ..... 297/192; 5/308; 312/246; 312/345

[58] Field of Search ..... 211/31; 297/192; 312/246, 345, 342, 235 A; 5/308, 2

[56] References Cited

U.S. PATENT DOCUMENTS

| | | | |
|---|---|---|---|
| 210,487 | 12/1878 | Bovey . | |
| 810,203 | 1/1906 | Hamilton | 312/345 X |
| 1,143,297 | 6/1915 | Moore et al. | 312/345 |
| 1,291,794 | 1/1919 | Droste | 5/308 |
| 1,295,043 | 2/1919 | Lattig . | |
| 1,566,664 | 12/1925 | Freakes . | |
| 1,568,212 | 1/1926 | Cygan | 312/345 X |
| 1,928,890 | 10/1933 | Haney et al. . | |
| 2,082,672 | 6/1937 | Waugh | 312/246 |
| 2,567,630 | 9/1951 | Whittier et al. | 5/308 |
| 2,652,887 | 9/1953 | Fitzgerald . | |
| 2,692,007 | 10/1954 | Christian . | |
| 2,693,226 | 11/1954 | Schweighart | 297/192 |
| 2,765,025 | 10/1956 | Bakalic et al. . | |
| 2,885,694 | 5/1959 | Ulur | 312/246 X |
| 3,544,157 | 12/1970 | Muller . | |
| 3,623,683 | 11/1971 | Bennett | 297/192 X |
| 4,061,395 | 12/1977 | Boole | 297/192 |

*Primary Examiner*—Peter A. Aschenbrenner
*Attorney, Agent, or Firm*—Kramer and Brufsky

[57] ABSTRACT

A portable drawer assembly for use with a four legged chair or the like having a space between the legs. The assembly comprises an enclosure having a top cover, both of which have a width which is selectively adjustable to effect the positioning thereof in the space between the four legs. The cover and enclosure can be mounted on the four legs so the drawer can be slid into and out of the space between the four legs or alternatively, it can be supported on legs pivotably mounted on the enclosure.

3 Claims, 5 Drawing Figures

PORTABLE DRAWER ASSEMBLY

BACKGROUND OF THE INVENTION

1. Field of The Invention

The present invention relates to a portable drawer assembly for use with a four legged piece of furniture having a space between the legs.

2. Description Of The Prior Art

Drawer assemblies of this type are known in the prior art, but these assemblies have the disadvantage of having a fixed width and therefore of not being able to optimally use the effective space between the four legs of the piece of furniture and of not being able to be used with a wide range of sizes of furniture.

Among the known prior art drawer assemblies that have these disadvantages are those taught in U.S. Pat. Nos. 210,487; 1,295,043; 1,566,664; 1,928,890; 2,652,887; 2,692,007; 2,765,025; and 3,544,157.

Accordingly, in my prior U.S. Pat. No. 4,061,395, issued Dec. 6, 1977, I disclosed a portable drawer that may be adjusted in its width to fit between the four legs of a piece of furniture and be slidably mounted therebetween. This was achieved by forming the drawer from two slidably engageable telescoping sections, which together constitute an enclosure that can be selectively adjusted in width for positioning between the legs of the furniture. The enclosure is slidably mounted to rods clamped to the legs along the length of the enclosure, so the drawer can be pulled outwardly from between the legs of the furniture for use.

The drawer enclosure however, did not have a top, cover or closure which is desirable when storing certain articles nor was the drawer readily removable from its mounted position and self-supporting, whereby a user would gain greater access to the interior of the enclosure. Further, by being readily removable, the enclosure would be immediately portable for use at different locations on different furniture. This invention provides a portable drawer assembly having such improved features.

SUMMARY OF THE INVENTION

In accordance with the invention, a complementary shaped cover is provided on the drawer enclosure which is adjustable in width by telescopically connecting two relatively slidable sections. The drawer enclosure and cover are adjustable to fit the space between the legs of the furniture and are attached therebetween by a pair of spring-slat clamps extending along the sidewalls of opposite sides of the cover, whereupon twisting of the slats enables ready removal of the cover and drawer enclosure. The sidewalls of the drawer enclosure are provided with pivotable legs for supporting the drawer and cover above a surface when not clamped between the furniture legs. The drawer enclosure is slidable lengthwise relative to the cover along a pair of rods suspending its interior from the cover enabling the drawer to be uncovered or opened for access whether in its self-supported mode or furniture supported mode.

BRIEF DESCRIPTION OF THE DRAWINGS

Further objects and advantages of the invention will become apparent from the following description and claims, and from the accompanying drawings wherein:

DETAILED DESCRIPTION OF THE INVENTION

Figure 1:
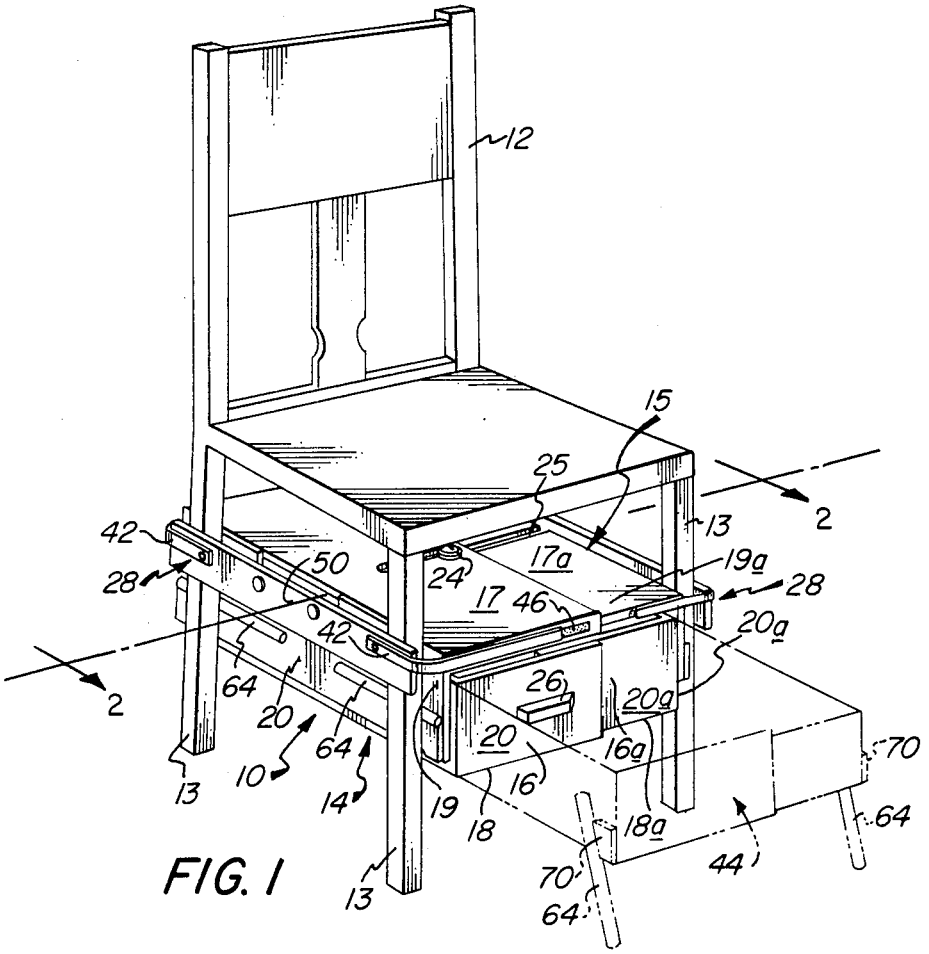
FIG. 1 is a perspective view of the portable drawer assembly of the present invention mounted on a chair.

Referring to the drawings in detail wherein like numerals indicate like elements throughout the several views, and particularly, to FIG. 1, a portable drawer assembly 10 is shown mounted to a chair 12.

Figure 2:
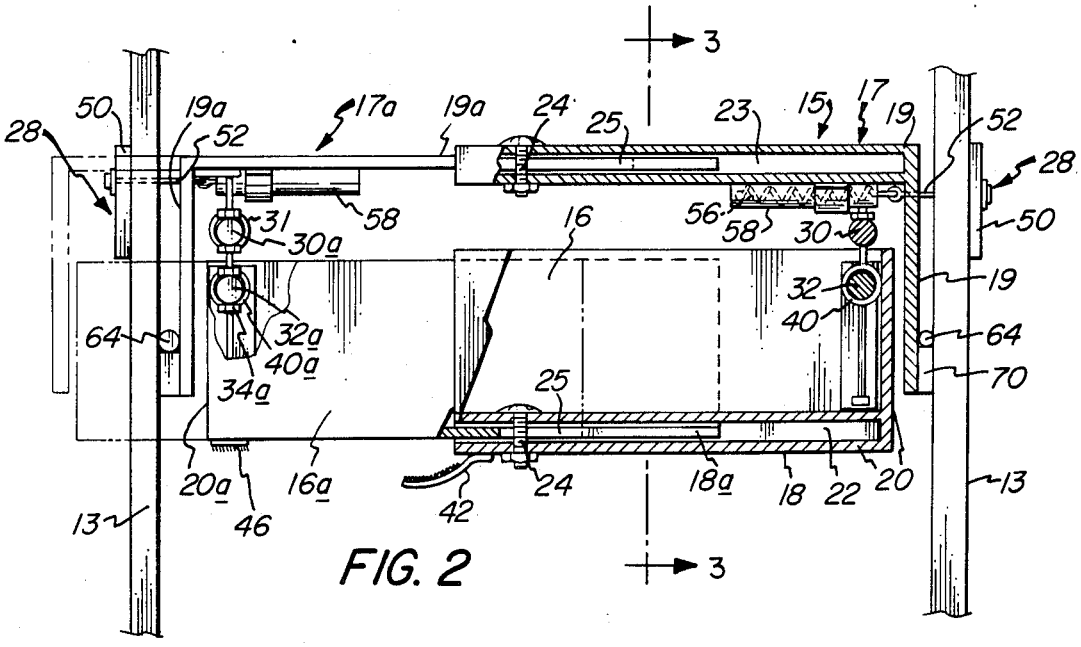
FIG. 2 is a partial cross-sectional view of the drawer assembly taken substantially along the plane indicated by line 2—2 of FIG. 1.

The assembly 10 may be used with any four legged piece of furniture that has a space between the legs 13 which are disposed rectangularly. The assembly 10 permits selective adjustment of the width of the drawer 14 to suit the piece of furniture beneath which it is mounted. The drawer 14 or enclosure is closed at the top by a cover 15, and each of the drawer 14 and cover 15 is constructed of first and second sections 16, **16*a*, 17, 17*a*, respectively that are telescopingly-engageable to one another. Each section 16, 16*a* has a rectangular base 18, 18*a* and three side walls 20, 20*a* each disposed perpendicular to its respective base 18, 18*a*. Similarly, each section 17, 17*a* of the cover 15 includes two walls 19, 19*a* each having a top rectangular portion and a vertical portion, said portions configured as a right angle to form an L. The base 18 and two side walls 20 of the first section 16 have slots 22 machined therein along the edges thereof that define an open side of the first section 16. The top portion of wall 19 of cover section 17 is also machined with a slot 23. The base 18*a* and corresponding two side walls 20*a* of the second section 16*a* are configured to be slidably received in the slot 22, while the top portion of wall 19*a* of cover 15 is slidably received in slot 23. A screw 24 in one or both of walls 18, 19 is slidable in a slot 25 in walls 18,19 respectively, to guide and maintain the two sections 16, 16*a* of the drawer 14 and sections 17, 17*a* of the cover in a selected position corresponding to a desired width as shown in FIG. 2. A handle 26 is connected to one side wall 20 of the first section 16 for grasping to slide the drawer assembly 14** open or closed, as will be described hereinafter.

The drawer assembly 14 with its cover 15 is mounted between the four legs 13 of the chair 12 for sliding movement in the space between said legs 13. Connected to each pair of legs 13 is a clamping member 28.

Figure 3:
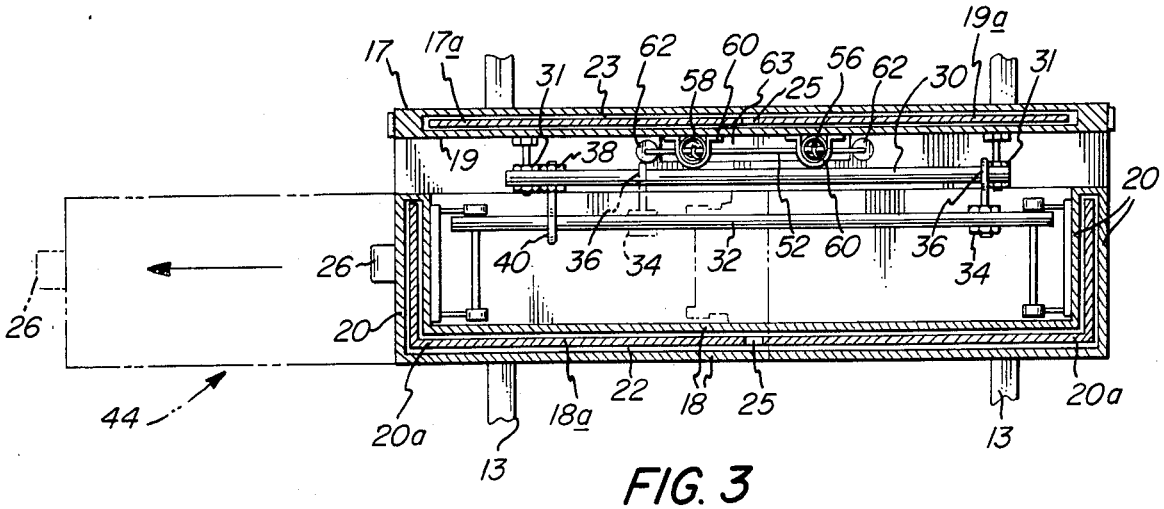
FIG. 3 is a cross-sectional view taken substantially along the plane indicated by line 3—3 of FIG. 2.
Figure 4:
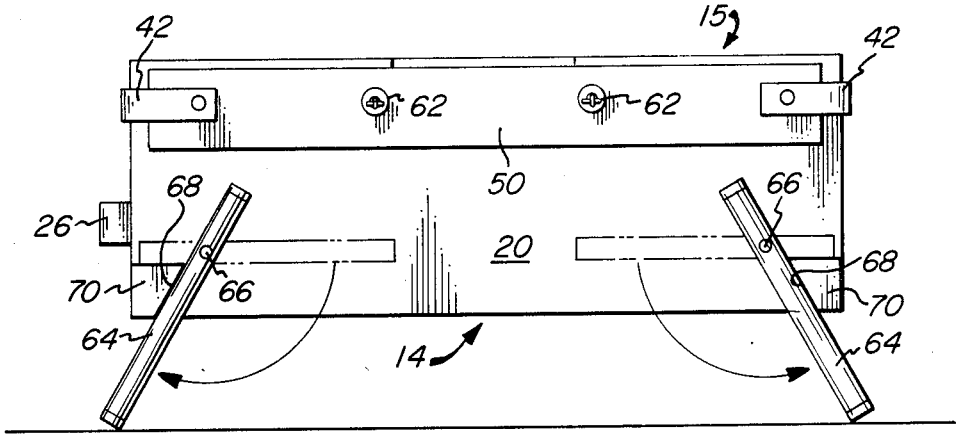
FIG. 4 is a side view of the drawer assembly of the present invention removed from a chair and supported on a plane surface.
Figure 5:
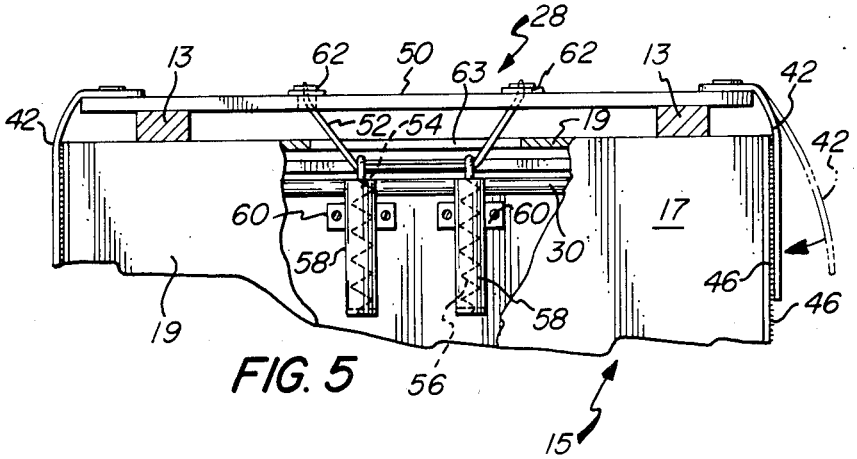
FIG. 5 is a partial top view of the drawer assembly of FIG. 2 with portions broken away and illustrated in section.

Each clamping member 28, as shown in FIGS. 2, 3 and 5, includes an elongated slat 50 adapted to span the space between a pair of chair legs 13 connected by a flexible wire 52 to the adjacent ends of a pair of elongatable coil springs 54, 56, each housed within a cylinder 58 secured by a collar 60 to the interior surface of the top portion of wall 19, **19*a* of section 17, 17*a*, respectively, of cover 15. In lieu of flexible wire 52, a curved rigid rod (not shown) can be used to mount coil springs 54, 56. Each end of wire 52 passes through an opening 63 in the vertical portion of wall 19 of section 17 and is secured by a pair of spaced grommets 62 to the slat 50. Wire 52 allows a slat 50 to be twisted or pivoted relative to the vertical portion of wall 19** of each cover section 17, 17*b* so that the cover 15 and attached drawer 14 can be positioned between the front and rear legs 13 of chair 12 and slats 50 manipulated to engage about the outer surfaces of a pair of adjacent legs 13 expanding springs 54, 56 which hold the vertical portions of walls 19, 19*a* against the interior of legs 13 as shown clearly in FIG. 5.

Two first or fixed rods 30, 30*a* are each connected between two clamping collars 31 along the length of the cover 15. Two second or movable rods 32, 32*a* are connected at two sides 20, 20*a* of each section 16, 16*a* along the length of drawer 14. Two first or rear connecting members 34, 34*a* are affixed with set screws or the like to its respective movable rod 32, 32*a* and is slidably connected to its respective fixed rod 30, 30*a* as shown in FIG. 3 by an eye member 36. Two second or front connecting members 38, 38*a* are affixed with set screws or the like to their respective fixed rods 30, 30*a* and are slidably connected to their respective movable rods 32, 32*a* by an eye member 40.

As illustrated in FIGS. 1 and 3, the drawer 14 can be pulled by handle 26 to an open position 44 and then reclosed by sliding drawer 14 and interior movable rods 32, 32*a* forwardly in eye members 40. Eye members 36 slide on fixed rods 30, 30*a* secured to the cover 15.

Slats 50 can aid in holding sections 17, 17*a* of the cover in adjusted relation by being further secured to cover 15 by straps 42 connected to the ends of each slat 50. Each strap 42 has Velcro fasteners 46 which are matingly engaged with a similar fastener 46 on the cover 15. Upon opening each strap 42 and twisting of slats 50 relative to the cover 15 and drawer 14, the entire drawer assembly 10 can be removed from the legs 13 of chair 12. Velcro fasteners on straps 42 are also connected to bases 18, 18*a* so that the bases 18, 18*a* can be prevented from sliding relative to each other when the drawer is collapsed, removed from the chair, and relocated.

The assembly 10 can be supported on a plane surface by pivoting support legs 64 about a pin 66 connecting each support leg 64 to each corner of a vertical side wall 20, 20*a* of drawer 14 until the leg abuts a stop surface 68 on a block 70 provided at each corner of the vertical side walls 20, 20*a*.

What is claimed is:

1. A portable drawer assembly for use with a four-legged piece of furniture having a space between the legs, such as a chair or the like, said assembly comprising:

an enclosure having a drawer and cover therefor, means for selectively adjusting the width of each of said drawer and cover to effect the positioning thereof in the space between the four legs, said drawer including first and second unitary sections each having a rectangular base and three side walls perpendicular thereto, said selective adjusting means including an integral slot in the base and two side walls of said first section along the open side thereof, the base and two side walls of said second section at the open side thereof being configured to be entirely slidably received in said integral slot;

said cover including first and second unitary sections each having a rectangular top portion and a vertical portion perpendicular to said top portion, said portions configured to form an L;

said selective adjustment means including an integral slot in the top portion of said first section slidably receiving the top portion of said second section;

means for removably mounting the cover in suspension from the four legs comprising clamping members for connecting said cover to the four legs, said clamping members including an elongated slat abutting the vertical portion of each of said cover sections and fixed thereto by flexible strand means, and spring means fixed to the top portion of each cover section received on said strand means for biasing a slat towards the vertical leg of each section of said cover; and means for mounting the drawer in suspension from said cover from sliding movement into and out of said space relative to said cover between the four legs.

2. The assembly of claim 1 wherein said mounting means for slidably mounting said drawer on said cover includes two first elongated rods fixed along the length of the cover, two second elongated rods connected at opposite sides of the top of the drawer along the length thereof, and two sets of first and second connecting members, each set disposed at one side of the drawer and suspending the same from said cover wherein the first connecting member of each set is fixedly connected to one first rod and slidably connected to one second rod at the front of the drawer and cover and the second connecting member of each set is fixedly connected to one second rod and slidably connected to one first rod at the rear of the drawer and cover.

3. An assembly according to claim 2, further comprising support legs pivotably mounted on the side walls adjacent each corner of said drawer and adapted to support said assembly on a plane surface when removed from the piece of furniture.

* * * * *